United States Patent [19]

Bétencourt

[11] Patent Number: 4,744,134

[45] Date of Patent: May 17, 1988

[54] SAFETY BELT BUCKLE, PARTICULARLY FOR AUTOMOBILES

[75] Inventor: Joseph Bétencourt, Point-De-Roide, France

[73] Assignee: Aciers et Outillage Peugeot, Audincourt, France

[21] Appl. No.: 931,833

[22] Filed: Nov. 18, 1986

[30] Foreign Application Priority Data

Nov. 20, 1985 [FR] France ..... 85 17172

[51] Int. Cl.[4] ..... A44B 11/25

[52] U.S. Cl. ..... 24/653; 24/642; 24/656

[58] Field of Search ..... 24/653, 654, 655, 656, 24/642; 297/468

[56] References Cited

U.S. PATENT DOCUMENTS

| | | | |
|---|---|---|---|
| 941,096 | 11/1909 | Pugatsky et al. | 24/656 |
| 3,181,215 | 5/1965 | Eberhart . | |
| 3,336,641 | 8/1967 | Hunter | 24/653 |
| 3,399,431 | 9/1968 | Shanklin et al. . | |
| 3,711,904 | 1/1973 | Gavagan et al. . | |
| 3,728,764 | 4/1973 | Carter . | |
| 3,812,556 | 5/1974 | Colombo . | |
| 3,963,090 | 6/1976 | Hollins | 24/656 |
| 3,969,795 | 7/1976 | Stephenson | 24/655 |
| 4,171,557 | 10/1979 | Ennerdal et al. | 24/642 |
| 4,597,141 | 7/1986 | Wier | 24/642 |

FOREIGN PATENT DOCUMENTS

| | | | |
|---|---|---|---|
| 0043239 | 1/1982 | Europan Pat. Off. | 24/642 |
| 2118590 | 7/1972 | France . | |
| 2239961 | 8/1973 | France . | |
| 2379995 | 4/1976 | France . | |
| 1589059 | 5/1981 | United Kingdom | 24/642 |

*Primary Examiner*—Victor N. Sakran

*Attorney, Agent, or Firm*—Sughrue, Mion, Zinn, MacPeak, and Seas

[57] ABSTRACT

This buckle, which is particularly for automobile safety belts and is intended to fix in a movable manner a side thereof to a fixed point in the body of the vehicle, comprising a hook assembly and a bolt (19) which is connected to the side to be fixed, with the hook assembly comprising, housed in a housing (1), a body (4) intended to be fixed to a holding means which is connected to the vehicle and which defines a passage and a sliding plane for said bolt, means for locking the bolt in the buckle, means for releasing the bolt and means for ejection thereof, is characterized in that the locking means are composed of a part (17) projecting from the body (4) extending into said passage, intended to be engaged into a cavity (20) of the bolt (19), in the locked position, and in that holding means (7) are provided for holding the bolt (19) in the locked position on said projecting part (17) of body (4).

7 Claims, 1 Drawing Sheet

SAFETY BELT BUCKLE, PARTICULARLY FOR AUTOMOBILES

Figure 1:
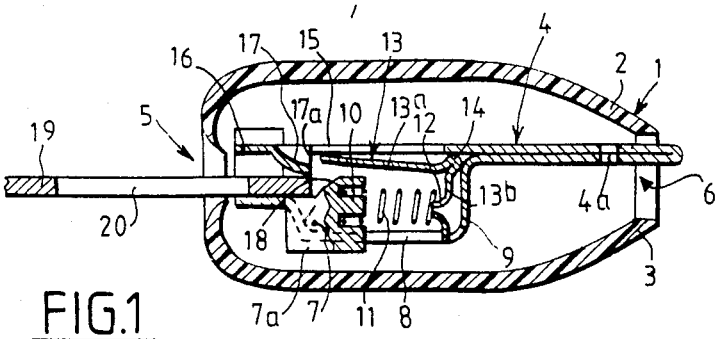
Figure 2:
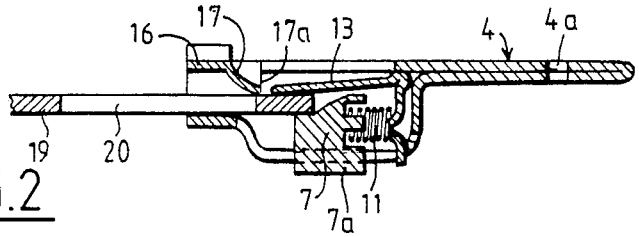

The present invention relates to devices intended to hold an automobile passenger in his seat in case of sudden deceleration of said automobile, for example during emergency braking or during a collision.

More specifically, the invention relates to a buckle which, in a device of the type indicated, is intended to fix in a movable manner a side of a safety belt to a fixed point in the body of the vehicle, by means for example of a tongue forming a locking bolt.

State-of-the-art buckles are known which comprise a housing in which a stirrup-shaped support is placed which is intended to be fixed to a holding means which is fixed in relation to the body of the vehicle and which defines between its wings a passage for guiding the bolt which exists at one end of said stirrup. In addition, these buckles comprise a locking component which is oscillatably mounted in the stirrup around an axis which is perpendicular to the wings of said stirrup as well as a stop component which is slidably mounted in said wings and which can be moved away by means of a control button, counter to the action of a resilient recall device.

In this type of buckle, the bolt is held in the buckle by a part projecting from the locking component which part prevents the withdrawal of the bolt from the locking passage, for example by being introduced into an opening provided in the bolt. During strong traction on the belt tending to withdraw the bolt from the buckle, this projecting part cooperates with a stop edge arranged in the bottom of the support stirrup, possibly through resilient deformation of the oscillation axis of the locking component in the stirrup, thereby providing high efficacy of the buckle and considerable holding force of the bolt.

From French Pat. No. 2,482,430 a safety belt buckle is also known which comprises a support intended to be fixed to a holding means and which defines a rectilinear passage in which the bolt can be introduced and which defines a sliding point therefor. The bolt locking component is articulated on the support around an axis which extends parallel to the plane of the passage. This locking component can have a first abutment surface holding the bolt and extending perpendicular to the plane of the passage, by being transversal in relation thereto, in the locked position of the buckle whereas the locking component can also have at least one second abutment surface which is intended, in the locked position of the buckle, to come into contact with a stop component translatably mounted on the support, in a direction perpendicular to the axis of articulation of the locking component. The movement of this stop component releases the locking component and therefore the bolt during opening of the buckle, which opening is controlled by a button mounted on the support so as to be able to move in the same direction as the stop component.

Recall springs are provided to act on the locking component, the stop component and the button. The stop component is formed by a monoblock body with components for guiding and holding the springs extending on either side of said body in directions perpendicularly opposite to the axis of articulation of the locking component.

From U.S. Pat. No. 3,399,431 a buckle particularly for automobile safety belts is known which is intended to fix in a movable manner a side of said belt to a fixed point in the body of the vehicle, which comprises a hook assembly and a bolt connected to the side to be fixed, with the hook assembly comprising, housed in a housing, a body intended to be fixed to a holding means connected to the vehicle, which defines a passage and a sliding plane for said bolt, means for locking the bolt in the buckle, composed of a part projecting from the body extending into said passage and intended to be engaged into a cavity of the bolt, in the locked position thereof, control means for releasing the bolt, means for ejection thereof and means for holding the bolt in the locked position on said part projecting from the body, composed of a slider which is mounted to be movable by said bolt during its introduction, in the body in the general direction of movement of the bolt.

The construction of such devices presents a certain number of disadvantages particularly with regard to respecting fairly tight tolerances during manufacture which increases the cost thereof.

In addition, in modern automobile technology it is desired to reduce as much as possible the weight and size of equipment at all levels, particularly in the field of safety equipment, without, however, of course sacrificing the efficacy of such equipment.

The object of the invention, therefore, is to provide a safety belt buckle whose construction is simple and whose mounting is easy, by reducing the number of components comprising such a buckle.

A further object of the invention is to provide a safety belt buckle which is smaller and lighter than the prior art buckles and whose manufacture can take place without respecting tight tolerances.

For this purpose, the object of the invention is a buckle, particularly for automobile seat belts, intended to fix in a movable manner a side thereof to a fixed point of the body of the vehicle, comprising a hook assembly and a bolt connected to the side to be fixed, the hook assembly comprising, housed in a housing, a body intended to be fixed to a holding means connected to the vehicle, which defines a passage and a sliding plane for said bolt, means for locking the bolt in the buckle, comprised by a part projecting from the body extending into said passage, and intended to be engaged into a cavity of the bolt, in the locked position thereof, means for control of the release of the bolt, means for ejection thereof, and means for maintaining the bolt in the locked position on said part projecting from the body, comprised of a slider mounted to be movable by said bolt during its introduction, in the body in the general direction of movement of the bolt, said slider being acted on by a resilient recall component and cooperating in the locked position of the bolt with the body and a corresponding surface of the bolt to maintain said bolt in position, under the action of said resilient component, said slider being mounted to be movable in said body under the action of the release control means between the holding position and a bolt release position, in which it cooperates with said ejection means to eject the bolt from the buckle, said ejection means being composed of said resilient recall component one end of which takes support against the slider and the other against a bolt release component, articulated in the body so as to release the bolt by disengaging the cavity thereof from the projecting part of the body following an action exerted on the slider by the bolt release control means, wherein the release component is composed by a component having two branches extending at approximately 90° in relation to one another, one of which cooperates with the resilient component and the other with a corresponding surface of the bolt, in order to release said bolt, and an articulating surface cooperating with the body.

Figure 5:
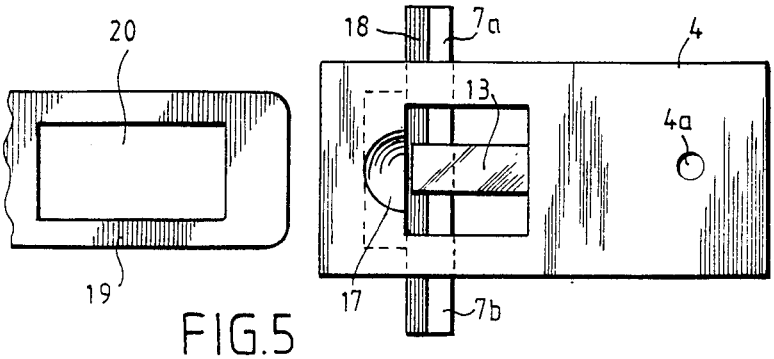

The invention will be better understood from the description which follows, which is given solely by way of example and by reference to the following the attached drawings, in which:

FIGS. 1 to 4 represent cross-sectional views illustrating the operation of a safety belt buckle in accordance with the invention; and FIG. 5 represents a view from above of a safety belt buckle in accordance with the invention.

As is shown in FIG. 1, a safety belt buckle in accordance with the invention comprises a housing 1 composed, for example, in a known manner of an upper element 2 and a lower element 3. Inside said housing 1 is arranged a hook assembly comprising a body 4 intended to be fixed to a holding means (not shown) which is connected to the vehicle.

Housing 1 also comprises a first opening 5, whose walls are inclined, exiting into body 4, which defines a passage and a sliding plane for, for example, a tongue forming a lock bolt which is connected to a side of the safety belt to be fixed.

Housing 1 also comprises a second opening 6 provided in the end of the housing opposite the end in which opening 5 is provided. This opening 6 is arranged opposite an end of body 4 and is intended for example to allow the passage of a holding means (not shown) one end of which is fixed to the vehicle and the other end of which is fixed to body 4 by means, for example, of a cavity 4*a* provided therein, so as to connect body 4 to the vehicle.

In accordance with another embodiment of the safety belt buckle in accordance with the invention, one part of body 4 can project beyond the housing 1 through opening 6 so as to enable mounting of an assembled buckle on the vehicle.

This buckle construction enables greater polyvalence thereof.

The safety belt buckle in accordance with the invention also comprises a slider 7 mounted so as to be movable by sliding in said body between a front position and a rear position as will be seen below, along the general direction of movement of the bolt in the body. This slider 7 comprises a guiding boss 7*a* arranged in a first opening 8 of a first part 9 of body 4 to ensure its guiding during its movement.

The slider also comprises a centering lug 10 which is intended to receive one end of a spring 11 whose function will be defined below, the other end of which is centered on a lug of a bolt release component 13 which is articulated on body 4.

This release component 13 is composed of a part with two branches 13*a*, 13*b* extending at approximately 90° in relation to one another, one of which cooperates with spring 11 and the other with a corresponding surface of the bolt to release same as will be described in more detail below.

This release component also comprises an articulation surface 14 which cooperates with the body, more particularly with a stop edge thereof, to provide its pivoting in relation thereto.

It should be noted that branch 13*a* of said release component extends in the direction of a second opening 15 of a second part 16 of body 4 which extends approximately parallel and at a certain distance from the first part thereof and thus defines the passage and the sliding plane for the bolt. This second part 16 of body 4 also comprises a projecting part 17, which for example is stamped, in proximity to opening 15 and which extends into the passage defined by the body, with this projecting part having a stop edge 17*a* intended as will be seen below to cooperate with an edge of a cavity of the bolt to lock same inside the buckle.

It should also be noted that the surface of the slider intended to cooperate with the front surface of the bolt during its introduction into the buckle has at least one ramp 18 whose function will be defined below.

In the released position of the buckle shown in FIG. 1, the slider takes support against an abutment surface of the first part 9 of the body. When a user introduces a bolt 19 comprising a cavity 20 between the two parts of body 4, the front surface thereof takes support against the slider 7 and more particularly against said at least one ramp 18 thereof. If the introduction of the bolt is continued (FIG. 2), the slider moves as the bolt penetrates into the buckle by compressing spring 11. This compression of spring 11 has the effect of pivoting the release component 13 around its articulation surface until branch 13*b* thereof takes support against the first part 9 of body 4. During this movement, since the front surface of the bolt takes support against the ramp of the slider, said slider exerts an action on the bolt which tends to make it go up towards the second part 16 of body 4. However, this rise is stopped by the full parts of the bolt coming into contact against the projecting part 17 of body 4. When the cavity 20 of the bolt arrives opposite this projecting part 17, the bolt can then go up into the body 4 under the action of the ramp of the slider and the of force exerted thereon by the spring 11.

Figure 3:
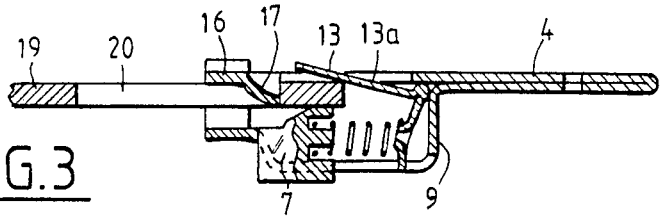
Figure 4:
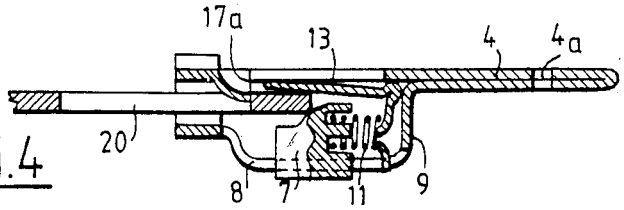

Thus, and as is shown on FIG. 3, when the cavity 20 of bolt 19 is totally engaged on the projecting part 17 of body 4, the slider 7 can move towards the front under the action of spring 11 so as to cooperate with the first part of body 4 and a corresponding surface of bolt 19 to maintain the cavity of the bolt in the locked position around the projecting part. When traction is exerted on the bolt tending to make it come out of the buckle, the projecting part 17 of body 4 and more particularly the stop edge 17*a* thereof and the corresponding edge of cavity 20 of the bolt cooperate together to retain the bolt in the buckle. On the other hand, the slider 7 prevents any movement of the bolt tending to disengage it from the projecting part of the body.

When the user wishes to release the buckle in accordance with the invention, he acts on the release control means (not shown) which cooperate with, for example, the projecting parts of the slider 7 to move said slider towards a rear release position of bolt 19. This movement also has the effect of compressing the spring 11 and of pivoting the release component 13 around its articulation surface such that branch 13*a* thereof takes support against a corresponding surface of the bolt and causes it, and more particularly cavity 20, to disengage itself from the projecting part 17 of body 4.

When the user ceases his action on the release control means, the spring exerts an action on the slider 7 to bring it back towards its front position and thus cooperate with the front surface of the bolt to eject it out of body 4.

The movement of the slider continues as long as it does not abut against the corresponding part of body 4 as has been previously described.

Thus, the locking means of the bolt are composed by a projecting part of the body, said projecting part being intended to be engaged in a cavity of the bolt, in the locked position thereof. On the other hand, the slider comprises means for holding the cavity of the bolt around said projection, said slider being mounted to be movable by said bolt during its introduction in the body in the general direction of movement of the bolt. The slider is also acted on by a resilient recall component and cooperates in the locking position of the bolt, with the body and a corresponding surface of the bolt in order to maintain said bolt in the locked position under the action of the resilient recall component.

On the other hand, the slider is also mounted so as to be movable in said body under the action of the release control means between this holding position and a release position of the bolt in which it cooperates with the ejection means to eject said bolt from the buckle. These ejection means are composed of the resilient recall means, one end of which takes support against the slider and the other against the release component of the bolt, said release component being articulated on the body in order to release the bolt by disengaging the cavity thereof from the projecting part of the body.

As can be seen on FIG. 5, the bolt release control means composed for example of sliding buttons arranged on either side of the housing can cooperate with the projecting parts *7a, 7b* of the slider which extend beyond body 4 in order to move same.

It should be noted that spring 11 is calculated in a known manner to enable the complete disengagement of the bolt cavity from the projecting part of the body before the release component goes back into the body. This is so as to avoid involuntary locking of the bolt during its ejection from the buckle.

On the other hand, the guide boss *7a* of the slider can comprise a projecting part cooperating with a release component sliding on one of the surfaces of the housing to provide the movement thereof and the release of the bolt.

I claim:

1. A buckle particularly for an automobile safety belt, intended to fix in a movable manner a side thereof to a fixed point of the body of the vehicle, comprising a hook assembly and a bolt (19) connected to the side to be fixed, the hook assembly comprising housed in a housing (1), a body (4) intended to be fixed to a holding means connected to the vehicle, which defines a passage and a sliding plane for said bolt, means for locking the bolt in the buckle, composed of a part (17) projecting from body (4) extending into said passage and intended to be engaged in a cavity (20) of bolt (19) in the locked position thereof, bolt release control means, means for ejection thereof and means (7) for holding the bolt (19) in the locked position on said projecting part (17) of the body (4), composed by a slider (7) mounted to be movable by said bolt during its introduction into body (4) in the general direction of movement of the bolt, said slider being acted upon a resilient recall component (11) and cooperating in the locked position of the bolt with body (4) and a corresponding surface of the bolt to maintain same in position, under the action of said resilient component, said slider (7) being mounted to be be movable in said body (4) under the action of release control means between the holding position and a release position of the bolt, in which it cooperates with said ejection means to eject the bolt from the buckle, said ejection means being composed of said resilient recall component (11), one end of which takes support against the slider (7) and the other against a bolt release component (13) which is articulated in body (4) to release the bolt by disengaging the cavity (20) thereof from the projecting part (17) of body (4) following an action exerted on the slider (7) by the bolt release control means, wherein the release component (13) is composed by a component having two branches (13*a*, 13*b*) extending at approximately 90° from one another, one of which (13*b*) cooperates with the resilient component (11) and the other (13*a*) with a corresponding surface of the bolt, in order to release same, and an articulation surface (14) cooperating with the body.

2. The buckle in accordance with claim 1, wherein the slider (7) comprises at least one projecting part (*7a, 7b*) extending beyond the body (4) and intended to cooperate with the bolt release control means.

3. The buckle in accordance with claim 1 or 2, wherein the articulation surface (14) of the locking component takes support against a stop edge of the body (4).

4. The buckle in accordance with claim 1 or 2, wherein the surface of the slider intended to cooperate with the front surface of the bolt (19) during its introduction into the buckle has at least one ramp (18) to cause the bolt to pivot towards its locked position and therefore the cavity (20) thereof to cooperate with the projecting part (17) of body (4).

5. The buckle in accordance with claim 4, wherein the slider (7) contains a boss (*7a*) arranged in an opening (8) of body (4) to ensure the guiding thereof during its movement.

6. The buckle in accordance with claim 1 or 2, wherein the projecting part (17) of body (4) is composed by a stamped part thereof, said part comprising a stop edge (17*a*) which cooperates with an edge of cavity (20) of bolt (19) in order to retain same in the buckle.

7. The buckle in accordance with claim 1 or 2, wherein the slider (7) contains a boss (*7a*) arranged in an opening (8) of body (4) to ensure the guiding thereof during its movement.

* * * * *